US010042313B2

(12) United States Patent
Ogata et al.

(10) Patent No.: US 10,042,313 B2
(45) Date of Patent: Aug. 7, 2018

(54) IMAGE FORMING APPARATUS FOR REDUCING INFLUENCE OF A ROTARY MEMBER'S SURFACE VELOCITY CHANGE

(71) Applicant: Konica Minolta, Inc., Chiyoda-ku, Tokyo (JP)

(72) Inventors: Satoshi Ogata, Hachioji (JP); Yumiko Izumiya, Hachioji (JP); Jun Onishi, Hino (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/267,761

(22) Filed: Sep. 16, 2016

(65) Prior Publication Data

US 2017/0082953 A1 Mar. 23, 2017

(30) Foreign Application Priority Data

Sep. 18, 2015 (JP) ..... 2015-184650

(51) Int. Cl.

*G03G 15/00* (2006.01)
*G03G 21/00* (2006.01)
*G03G 15/16* (2006.01)

(52) U.S. Cl.

CPC ..... *G03G 21/0005* (2013.01); *G03G 15/1615* (2013.01); *G03G 15/505* (2013.01);
(Continued)

(58) Field of Classification Search

CPC ..... G03G 15/5008; G03G 15/505; G03G 15/5054; G03G 15/757; G03G 15/1615; G03G 2215/00075
(Continued)

(56) References Cited

U.S. PATENT DOCUMENTS 5,708,933 A * 1/1998 Nogami ..... G03G 15/757 399/167
5,737,216 A * 4/1998 Hokari ..... G01P 3/489 318/685
(Continued)

FOREIGN PATENT DOCUMENTS

JP H09-015975 A 1/1997
JP 2004-004573 A 1/2004
(Continued)

OTHER PUBLICATIONS

Office Action (Notice of Reasons for Rejection) dated Aug. 29, 2017, by the Japanese Patent Office in corresponding Japanese Patent Application No. 2015-184650, and an English Translation of the Office Action. (16 pages).
(Continued)

*Primary Examiner* — Robert Beatty
(74) *Attorney, Agent, or Firm* — Buchanan Ingersoll & Rooney PC

(57) ABSTRACT

An image forming apparatus includes an image carrier, an image carrier driver which rotates the image carrier, a rotation detector which detects rotation of the image carrier, a rotary member in contact with the image carrier, a rotary member driver which rotates the rotary member, a first controller which controls the rotary member driver, and a second controller. The second controller controls the image carrier driver based on an output of the rotation detector and also controls the image carrier driver in a manner which attenuates a fluctuation component at a specific frequency. When the first controller changes a surface velocity of the rotary member, the second controller controls the image carrier driver in a manner that attenuates a fluctuation component at a specific frequency related to the changed surface velocity of the rotary member.

7 Claims, 3 Drawing Sheets

(52) U.S. Cl.
CPC ..... *G03G 15/5008* (2013.01); *G03G 2215/00075* (2013.01)

(58) Field of Classification Search
USPC ..... 399/167
See application file for complete search history.

(56) References Cited

U.S. PATENT DOCUMENTS

| | | | | |
|---|---|---|---|---|
| 5,749,031 | A | 5/1998 | Miwa et al. | |
| 6,456,808 | B1 * | 9/2002 | Chen | G03G 15/5008 399/167 |
| 6,898,386 | B2 * | 5/2005 | Takigawa | G03G 15/0131 399/302 |
| 6,990,304 | B2 * | 1/2006 | Mitamura | G03G 15/754 399/167 |
| 7,343,119 | B2 * | 3/2008 | Matsuda | G03G 15/0131 399/167 |
| 9,658,578 | B2 * | 5/2017 | Matsuda | G03G 15/1615 |
| 2003/0223768 | A1 | 12/2003 | Takigawa | |
| 2004/0184845 | A1 | 9/2004 | Mitamura et al. | |
| 2009/0324262 | A1 * | 12/2009 | Matsuda | G03G 15/5008 399/36 |
| 2011/0229164 | A1 | 9/2011 | Watahiki | |
| 2014/0169812 | A1 * | 6/2014 | Takatsu | G03G 15/5008 399/38 |

FOREIGN PATENT DOCUMENTS

| | | | |
|---|---|---|---|
| JP | 2004-229353 | A | 8/2004 |
| JP | 2004-287083 | A | 10/2004 |
| JP | 2006-215117 | A | 8/2006 |
| JP | 2011-215605 | A | 10/2011 |
| JP | 2013-025270 | A | 2/2013 |
| JP | 2015-096893 | A | 5/2015 |

OTHER PUBLICATIONS

Office Action (Notification of the First Office Action) dated Jun. 4, 2018, by the Chinese Patent Office in corresponding Chinese Patent Application No. 201610819556.2, and an English Translation of the Office Action (9 pages).

* cited by examiner

IMAGE FORMING APPARATUS FOR REDUCING INFLUENCE OF A ROTARY MEMBER'S SURFACE VELOCITY CHANGE

BACKGROUND OF THE INVENTION

1. Field of the Invention

The present invention relates to an image forming apparatus.

2. Description of Related Art

In the field of image forming apparatuses, it has been known in the art that the surface velocity fluctuation of an image carrier causes degradation in image quality, such as irregular pitch and color misalignment. On the other hand, in the field of product printers, the diameter of an image carrier has been increased in order to achieve higher durability, but a larger diameter leads to a larger influence of surface velocity fluctuation.

To achieve both high image quality and high durability, an image carrier is controlled in such a manner that a fluctuation component at a specific frequency caused by a drive mechanism for driving the image carrier is corrected within a narrow range by using a coefficient that has the characteristic of attenuating the fluctuation component.

However, image forming apparatuses include a rotary member such as a lubricant brush that is in contact with an image carrier and is driven at a different surface velocity. The rotation of the rotary member causes a surface velocity fluctuation of the image carrier, which results in degraded image quality.

Some of the known techniques to address the problem include controlling the surface velocity of a rotary member that has an influence on an image carrier (see JP 2004-004573A), bringing a damper roll, which is used for reducing the fluctuation, into contact with an image carrier when the surface velocity of the image carrier fluctuates (see JP 2004-287083A), and the like. Further, an image forming apparatus has been disclosed in which, when there is a large difference in surface velocity between an image carrier and a rotary member in contact with the image carrier, a slip at the contact portion reduces the surface velocity fluctuation to a level such that no further measures are required in order to reduce the surface velocity fluctuation (see JP 2013-025270A).

However, in recent years, there has been a need to arbitrarily change the surface velocity of a rotary member in contact with an image carrier regardless of the surface velocity of the image carrier in order to achieve higher image quality and higher durability. In this regard, the image forming apparatus of JP 2004-004573A cannot reduce the surface velocity fluctuation because the surface velocity of the rotary member cannot be arbitrarily changed. The driver of the image carrier of JP 2004-287083A requires an additional component, and the problems of higher cost and lower reliability arise due to the complicated structure.

A problem with the image forming apparatus of JP 2013-025270A is that even when there is a large difference in surface velocity between the image carrier and the rotary member in contact with the image carrier, the surface velocity fluctuation of the image carrier is not always reduced depending on the surface velocity of the rotary member. For example, there is a case in which the velocity of a photoreceptor drum is affected by the fluctuation of a brush of a supplementary cleaning member despite a velocity difference of at least 30% or more between the brush and the photoreceptor drum.

SUMMARY OF THE INVENTION

It is an object of the present invention to provide an image forming apparatus that can reduce the influence of a surface velocity change of a rotary member.

In order to realize the above object, according to a first aspect of the present invention, there is provided an image forming apparatus, including:

an image carrier;

an image carrier driver which rotates the image carrier;

a rotation detector which detects rotation of the image carrier;

a rotary member in contact with the image carrier;

a rotary member driver which rotates the rotary member;

a first controller which controls the rotary member driver to rotate the rotary member; and a second controller which controls the image carrier driver based on an output of the rotation detector to rotate the image carrier and also controls the image carrier driver in a manner which attenuates a fluctuation component at a specific frequency, wherein when the first controller changes a surface velocity of the rotary member, the second controller controls the image carrier driver in a manner that attenuates a fluctuation component at a specific frequency related to the changed surface velocity of the rotary member.

Preferably, the second controller controls the image carrier driver in a manner which attenuates both a fluctuation component at a specific frequency caused by the image carrier driver and the fluctuation component at the specific frequency related to the surface velocity of the rotary member.

Preferably, the first controller changes the surface velocity of the rotary member in stages at predetermined velocity intervals, and the second controller changes the control of the image carrier driver in stages so as to attenuate the fluctuation component at the specific frequency related to the surface velocity of the rotary member according to the change of the surface velocity.

Preferably, the image carrier is constituted by a photoreceptor drum, and the rotary member is constituted by a cleaning member and/or a supplementary cleaning member.

Preferably, the image carrier is constituted by an intermediate transfer belt, and the rotary member is constituted by a secondary transfer member.

Preferably, the secondary transfer member is constituted by a transfer roller or a transfer belt.

BRIEF DESCRIPTION OF THE DRAWINGS

The present invention will become more fully understood from the detailed description given hereinbelow and the appended drawings which are given by way of illustration only, and thus are not intended as a definition of the limits of the present invention, and wherein.

DETAILED DESCRIPTION OF THE PREFERRED EMBODIMENT

Embodiment

1. Description of Configuration

Hereinafter, a specific embodiment of the present invention will be described with drawings. However, the scope of the present invention is not limited to the illustrated examples.

Figure 1:
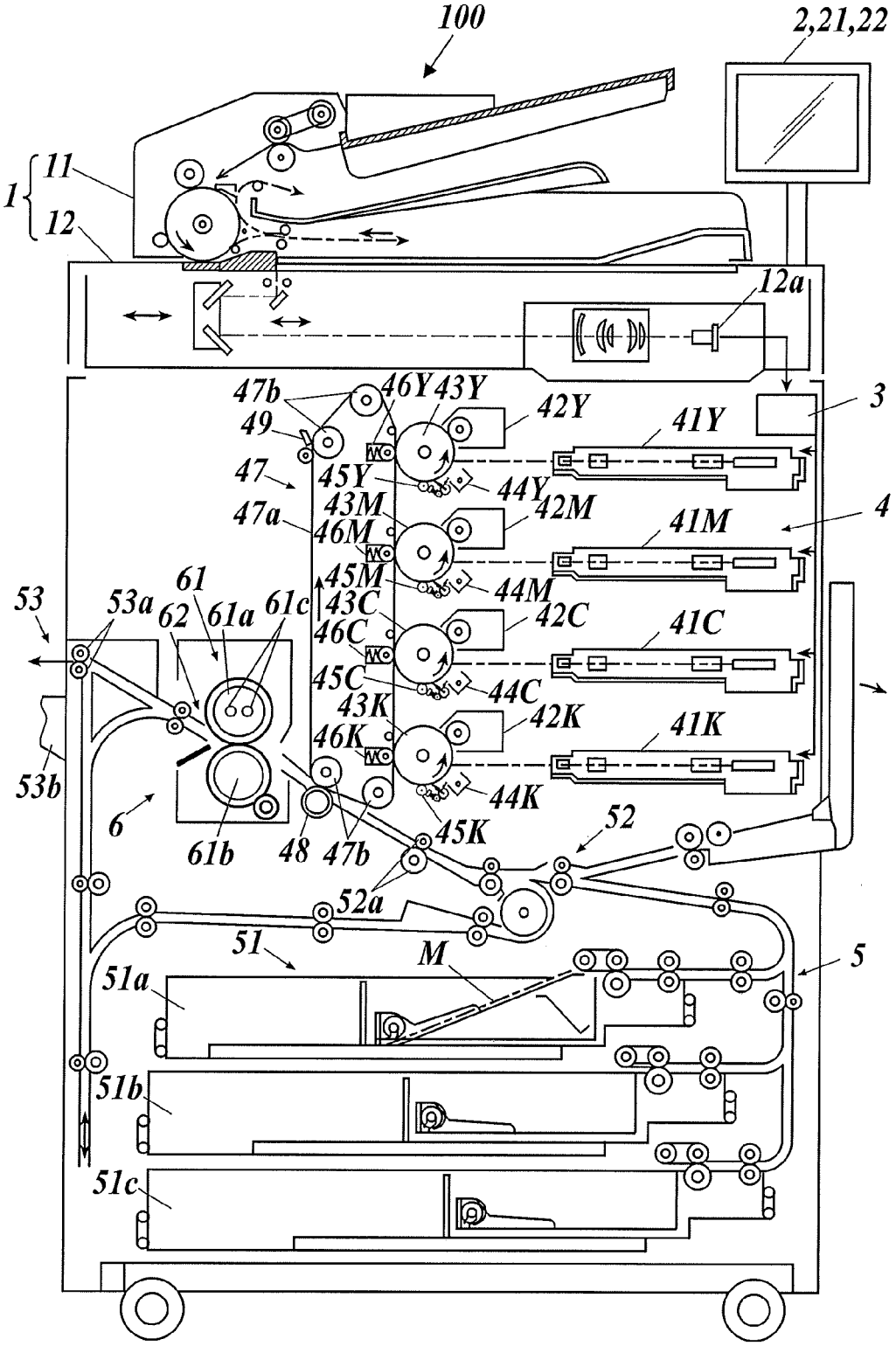
FIG. 1 illustrates the schematic configuration of an image forming apparatus according to an embodiment of the present invention.
Figure 2:
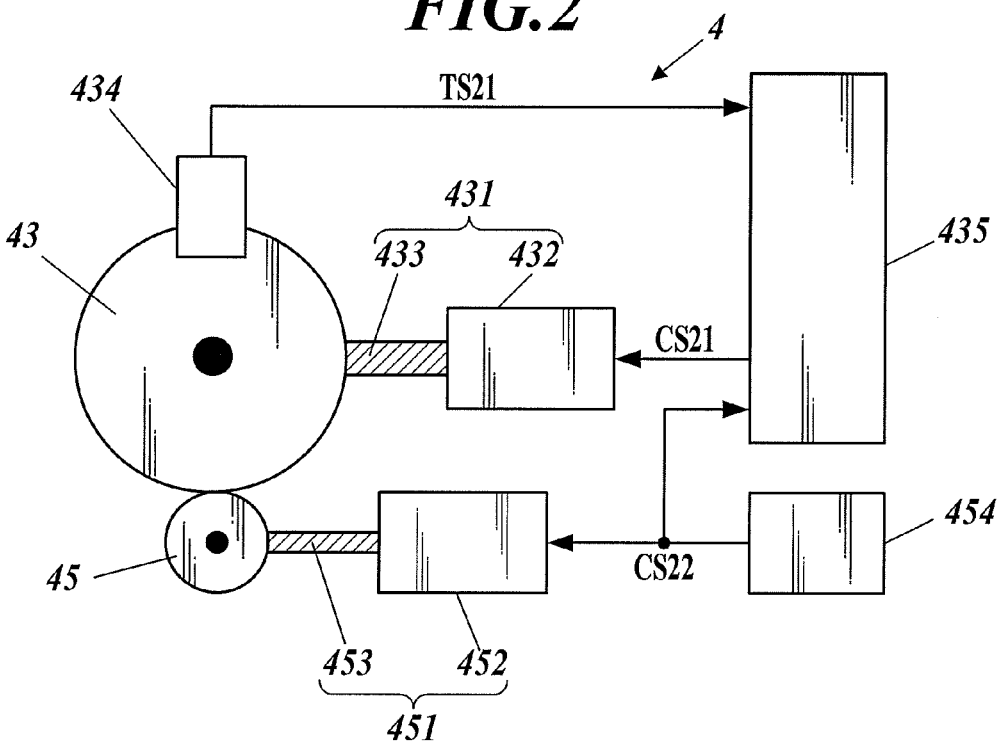
FIG. 2 is an explanatory view of the detailed configuration of an image forming section.

FIG. 1 illustrates the schematic configuration of an image forming apparatus 100 according to an embodiment of the present invention. FIG. 2 is an explanatory view of the detailed configuration of an image forming section.

As illustrated in FIG. 1, the image forming apparatus 100 of the embodiment forms an image by overlaying colors on a sheet (recording medium) M based on an image data that is obtained by reading a color image on an original or an image data that is input from external information equipment (e.g. personal computer) through a network.

The image forming apparatus 100 is a tandem image forming apparatus in which photoreceptor drums 43Y, 43M, 43C and 43K corresponding to four colors of yellow (Y), magenta (M), cyan (C) and black (K), respectively, are disposed in series in the running direction of an intermediate transfer belt 47*a*, and the respective color toner images are sequentially transferred to a transfer body in a single process.

Specifically, the image forming apparatus 100 of this embodiment includes an image reader 1, an operation display 2, an image processor 3, an image forming section 4, a conveyer 5, a fixing device 6, a controller (not shown) and the like.

The image reader 1 includes an automatic document feeder 11 (also referred to as an ADF), a document image scanner 12 and the like.

The automatic document feeder 11 conveys an original mounted on a document tray to the document image scanner by means of a conveyance mechanism. The automatic document feeder 11 enables images on (both sides of) a number of sheets of original mounted on the document tray to be read successively.

The document image scanner 12 reads the original image by optically scanning either the original conveyed from the automatic document feeder 11 onto a contact glass or the original manually mounted on the contact glass and focusing the reflecting light from the original on a light receiving surface of a CCD (charge coupled device) sensor 12*a*. The image (analog image signal) read by the image reader 1 is subjected to a predetermined image processing in the image processor 3.

As used herein, the term "image" includes not only image data such as figures and photographs but also text data such as characters and symbols.

The operation display 2, which is constituted by a liquid crystal display (LCD) with a touch panel, or the like, serves as a display 21 and an operation section 22.

The display 21 displays various operation windows, image conditions, the operation status of various functions and the like according to a display control signal input from the controller (not shown).

The operation section 22, which includes various operation keys such as numeric keys and a start key, receives inputs from various user operations and outputs an operation signal to the controller (not shown).

The image processor 3 includes a circuit for analog-digital (A/D) conversion, a circuit for digital image processing and the like.

The image processor 3 performs A/D conversion on the analog image signal from the image reader 1 so as to generate a digital image data (RGB signal). The image processor 3 further performs color conversion, gradation reproduction (e.g. screening), corrections (e.g. shading) according to a default setting or a user setting, compression and the like on the digital image data. Based on the digital image data (YMCK signal) on which this processing is performed, the image forming section 4 is controlled.

The image forming section 4 includes exposure devices 41Y, 41M, 41C and 41K, developers 42Y, 42M, 42C and 42K, photoreceptor drums 43Y, 43M, 43C and 43K, chargers 44Y, 44M, 44C and 44K, lubricant applier/removers 45Y, 45M, 45C and 45K and primary transfer rollers 46Y, 46M, 46C and 46K, which are provided corresponding to the respective color components Y, M, C and K. The image forming section 4 also includes an intermediate transfer unit 47 and the like.

In a unit for the Y component of the image forming section 4, the charger 44Y charges the photoreceptor drum 43Y. The exposure device 41Y, which is constituted by a semiconductor laser for example, irradiates the photoreceptor drum 43Y with a laser beam corresponding to the Y component. As a result, an electrostatic latent image of the Y component is formed on the surface of the photoreceptor drum 43Y. The developer 42Y stores a developing agent for the Y component (e.g. two-component developing agent composed of micro toner particles and a magnetic material). The developer 42Y develops the electrostatic latent image (forms a toner image) by making the Y component toner adhere to the surface of the photoreceptor drum 43Y.

Similarly, units for the M, C and K components form the respective color toner images on the surfaces of the photoreceptor drums 43M, 43C and 43K.

The lubricant applier/removers 45Y, 45M, 45C and 45K apply lubricant to the surface of the photoreceptor drums 43Y, 43M, 43C and 43K and also remove excess lubricant and foreign objects attached to the surface of the photoreceptor drums 43Y, 43M, 43C and 43K.

The intermediate transfer unit 47 is configured such that an endless intermediate transfer belt 47*a*, which serves as a transfer body, is stretched and supported by support rollers 47*b*.

The intermediate transfer belt 47*a* is brought into pressure contact with the photoreceptor drums 43Y, 43M, 43C and 43K by means of the primary transfer rollers 46Y, 46M, 46C and 46K so that the respective color toner images are sequentially overlaid on the intermediate transfer belt 47*a*. The primary transfer is thus completed. Then, the intermediate transfer belt 47*a* on which the toner image has been primarily transferred is brought into contact with the sheet M by means of a secondary transfer roller 48 so that the toner image is secondarily transferred to the sheet M.

After the secondary transfer, the residual toner on the intermediate transfer belt 47*a* is removed by means of a blade or the like of a cleaning device 49.

The conveyer 5 includes a sheet feeder 51, a conveyance mechanism 52, a sheet ejector 53 and the like.

The sheet feeder 51 includes three sheet feeding tray units 51*a* to 51*c*. The sheet feeding tray units 51*a* to 51*c* store the sheets M according to the preset sheet types, which are standard papers and special sheets classified by basis weight and size. The sheets M stored in the sheet feeding tray units 51*a* to 51*c* are discharged one by one from the uppermost sheet and are conveyed to the image forming section 4 by means of the conveyance mechanism 52 that includes conveyance rollers such as resist rollers 52*a*. During conveyance, a resist portion, in which the resist rollers 52*a* are disposed, corrects the inclination of the fed sheet M and also adjusts the conveyance timing.

Then, the toner image on the intermediate transfer belt 47*a* is secondarily transferred to an image forming face of the sheet M in the image forming section 4, and the transferred image is subjected to a fixing step in the fixing device 6. The sheet M on which the image has been formed is ejected to an outside sheet eject tray 53*b* by means of a sheet ejector 53 including sheet eject rollers 53*a*.

The fixing device 6 includes a fixing roller 61*a*, a press roller 61*b* and the like. The fixing device 6 performs the fixing step for fixing the toner image transferred on the sheet M. The fixing roller 61*a* and the press roller 61*b* constitute a nip portion that nips and conveys the sheet M.

The fixing roller 61*a* is disposed on the image forming side of the sheet M. The fixing roller 61*a* is rotated by a driving means (not shown) such as a motor.

For example, the fixing roller 61*a* is configured such that an elastic layer made of silicone rubber or the like is formed on the outer circumferential face of a cylindrical core metal made of iron or the like. The fixing roller 61*a*, which is equipped with a fixing heater 61*c* such as a halogen heater, comes in contact with the image forming face of the sheet M on which the toner image has been transferred so as to heat the sheet M at a predetermined fixing temperature. That is, while the fixing roller 61*a* is rotating, it comes in contact with the image forming face of the sheet M so as to heat the sheet M.

The predetermined fixing temperature refers to a temperature at which a sufficient amount of heat can be applied for melting the toner while the sheet M is passing through the nip portion, which differs depending on the type of the sheet M on which an image is formed.

The press roller 61*b* is disposed opposite the fixing roller 61*a* and is pressed against the fixing roller 61*a* at a predetermined pressing force. That is, the press roller 61*b* together with the fixing roller 61*a* serves as a pressing portion that nips and presses the sheet M.

For example, the press roller 61*b* is configured such that an elastic layer made of silicone rubber or the like is formed on the outer circumferential face of a cylindrical core metal made of iron or the like. Further, the surface of the press roller 61*b* is hard relative to the surface of the fixing roller 61*a*. With this configuration, the press roller 61*b* that is pressed against the fixing roller 61*a* digs into the surface elastic layer of the fixing roller 61*a* in the nip portion.

2. Description of Configuration of Image Forming Section

Hereinafter, a drive control of the image carrier will be described in detail with reference to FIG. 2 and FIG. 3.

FIG. 2 illustrates the configuration of the components that drive an image carrier 43 (e.g. the photoreceptor drum 43Y) of the image forming section 4 and a rotary member 45 (e.g. the lubricant applier/remover 45Y) in contact with the image carrier 43.

The image carrier 43 is rotated by an image carrier driver 431, and the rotary member 45 is rotated by a rotary member driver 451. For example, the image carrier driver 431 is constituted by a driving motor 432 and a power transmission mechanism 433, and the rotary member driver 451 is constituted by a driving motor 452 and a power transmission mechanism 453.

The driving motor 432 rotates the image carrier 43, in which the power of the driving motor 432 is transmitted to the image carrier 43 through the power transmission mechanism 433 such as a gear train.

The driving motor 452 rotates the rotary member 45 at a different surface velocity from that of the image carrier 43, in which the power of the driving motor 452 is transmitted to the rotary member 45 through the power transmission mechanism 453 such as a gear train.

In the vicinity of the image carrier 43, a rotation detector 434 is provided to detect the surface velocity (rotation speed) of the image carrier 43 and to output it as a surface velocity signal TS21.

A controller 435 receives the detected surface velocity signal TS21 from the rotation detector 434 and generates a control signal CS21 based on the surface velocity signal TS21. The controller 435 outputs the control signal CS21 to the driving motor 432 to control the operation thereof, so as to control the surface velocity of the image carrier 43.

Specifically, a so-called PI (proportional-integral) control is employed for the control, in which the control signal CS21 is calculated from two elements which are the deviation of the detected surface velocity signal TS21 from a target velocity and the integral thereof. In this regard, the controller 435 performs the calculation by using a control coefficient that has the characteristic of attenuating the fluctuation component at a specific frequency, so as to generate the final control signal CS21.

For example, the following calculations are performed in a typical PI control, where A is the deviation of the surface velocity signal TS21 from the target velocity in the current detection, B is the deviation in the last detection, BCMP1 is the coefficient of the proportional component, BCMP2 is the coefficient of the integral component, and RSB is the last calculation result. First, the following calculation is performed:

$$\text{temp}=A\times BCMP1+B\times BCMP2 \quad (1)$$

Then, the current calculation result RSA is calculated as follows:

$$RSA=RSB+\text{temp} \quad (2)$$

When the control coefficient having the characteristic of attenuating the fluctuation component at a specific frequency is used for the calculation, a calculation to attenuate the fluctuation component at a specific frequency by the control coefficient is repeated to the number of frequencies at which the fluctuation is attenuated, which are performed separately from the above-described PI control. Then, the calculation results for the respective frequencies of the fluctuations to be attenuated are added to the current calculation result RSA. For example, a calculation to attenuate the fluctuation component at a specific frequency is performed using a function including a lag order based on the deviation of the surface velocity signal TS21 from the target velocity (the function including the control coefficient as a fixed value).

As used herein, the fluctuation component at a specific frequency refers to a fluctuation component caused by the image carrier driver 431 such as the fluctuation component at a specific frequency that occurs in every rotation of the image carrier 43 or the fluctuation component at a specific frequency that occurs in every rotation of the driving motor 432. Further, it also refers to the fluctuation component at a specific frequency related to the surface velocity of the rotary member 45, which is different from that of the image carrier 43.

The control coefficient has the property of attenuating the gains at these specific frequencies within narrow ranges so as to attenuate the fluctuation components at the specific frequencies. For example, the control coefficient is generated for each of two or more conditions, and the different control coefficients are stored in the controller 435 in the form of a table.

Figure 3:
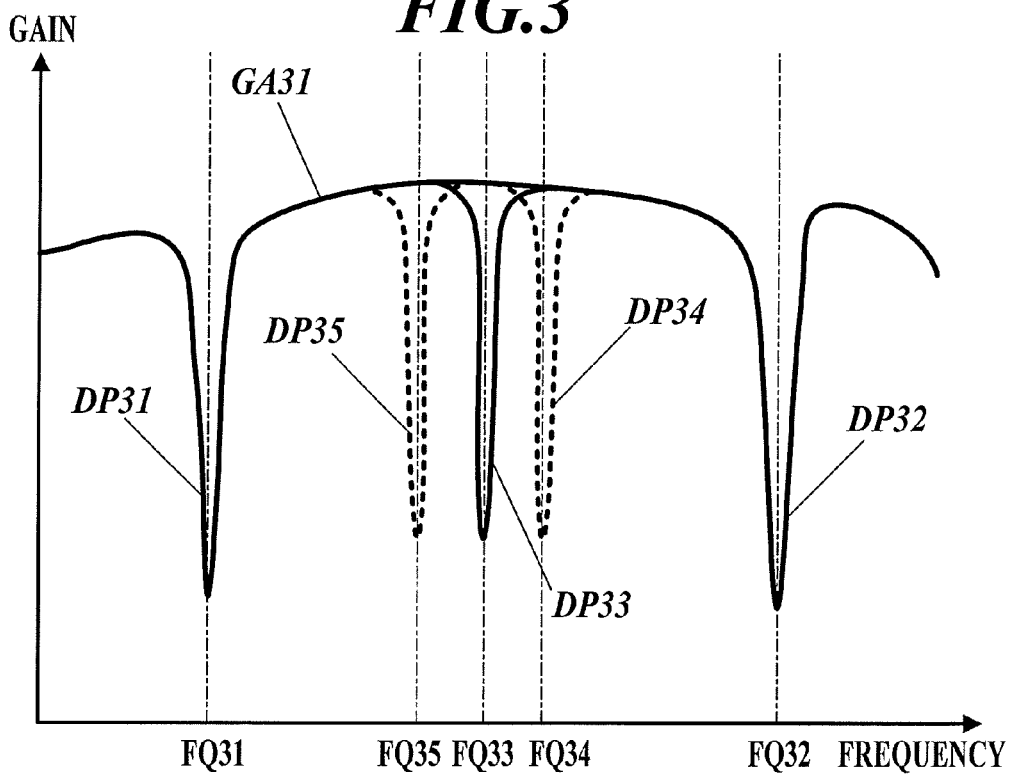
FIG. 3 is an explanatory view of an example of a control coefficient that has the characteristics of attenuating a fluctuation component at a specific frequency.

Specifically, the control coefficient has the characteristic curve GA31 as illustrated in FIG. 3. For example, the frequency FQ31 is the specific frequency of the fluctuation that occurs in every rotation of the image carrier 43, and the frequency FQ32 is the specific frequency of the fluctuation that occurs in every rotation of the driving motor 432. The control coefficient attenuates the gains at the frequencies within narrow ranges by the characteristic curves DP31 and DP 32 as illustrated in FIG. 3 to reduce the fluctuations at the frequencies.

Further, the frequency FQ33 is, for example, the specific frequency related to the surface velocity of the rotary member 45. The fluctuation at this frequency can be reduced in a narrow range by attenuating the gain at the frequency by using the characteristic curve DP33 as illustrated in FIG. 3.

A controller 454 generates a control signal CS22 and outputs it to the driving motor 452 to control the operation thereof, so as to control the surface velocity of the rotary member 45 independently from the surface velocity of the image carrier 43. The control signal CS22 is also output to the controller 435.

3. Description of Control of Image Carrier

The controller 435 controls the image carrier driver 431 based on the output of the rotation detector 434 so as to rotate the image carrier 43, in which the control coefficient that has the characteristics of attenuating the fluctuation components at the specific frequencies is used. For example, the control coefficient that is used for controlling the rotation of the image carrier 43 has the characteristic of attenuating the gains at the frequencies FQ31, FQ32 and FQ33 by the characteristic curves DP31, DP32 and DP33 within narrow ranges as illustrated in FIG. 3.

In this process, the controller 435 receives the control signal CS22 from the controller 454 so as to detect whether there is a change in the surface velocity of the rotary member 45. If there is a change in the surface velocity of the rotary member 45, the controller 435 changes the control coefficient so that it has the characteristic of attenuating the fluctuation component at a specific frequency related to the changed surface velocity.

For example, the controller 435 changes the specific frequency related to the surface velocity of the rotary member 45 from FQ33 to FQ34 or FQ35 corresponding to the change of the surface velocity so that the control coefficient has the characteristic of attenuating the gain at the changed frequency by the characteristic curve DP34 or DP35 within a narrow range as illustrated in FIG. 3. The control section 435 thus controls the rotation of the image carrier 43 by using the changed control coefficient.

Even when, in order to achieve higher image quality and higher durability, the surface velocity of the rotary member 45 in contact with the image carrier 43 is arbitrarily variable regardless of the surface velocity of the image carrier 43, the influence of a change in the surface velocity of the rotary member 45 can be reduced by switching the control coefficient for the drive control so that it has the characteristic of attenuating the gain at the specific frequency related to the changed surface velocity of the rotary member 45 in a narrow range.

As described above, the image forming apparatus 100 of the embodiment is configured such that the controller 435 controls the image carrier driver 431 to rotate the image carrier 43 based on the output of the rotation detector 434 and also controls the image carrier driver 431 in a manner that attenuates the fluctuation component at a specific frequency. Further, the controller 435 controls the image carrier driver 431 in a manner that attenuates the fluctuation component at a specific frequency related to the changing surface velocity. Therefore, the influence of a change in the surface velocity of the rotary member 45 can be reduced.

Variation 1

In the description of the embodiment, the surface velocity of the rotary member 45 is not specifically described in terms of the degree of change and the like. In this regard, the control section 454 may change the surface velocity of the rotary member 45 in stages at predetermined velocity intervals.

Figure 4:
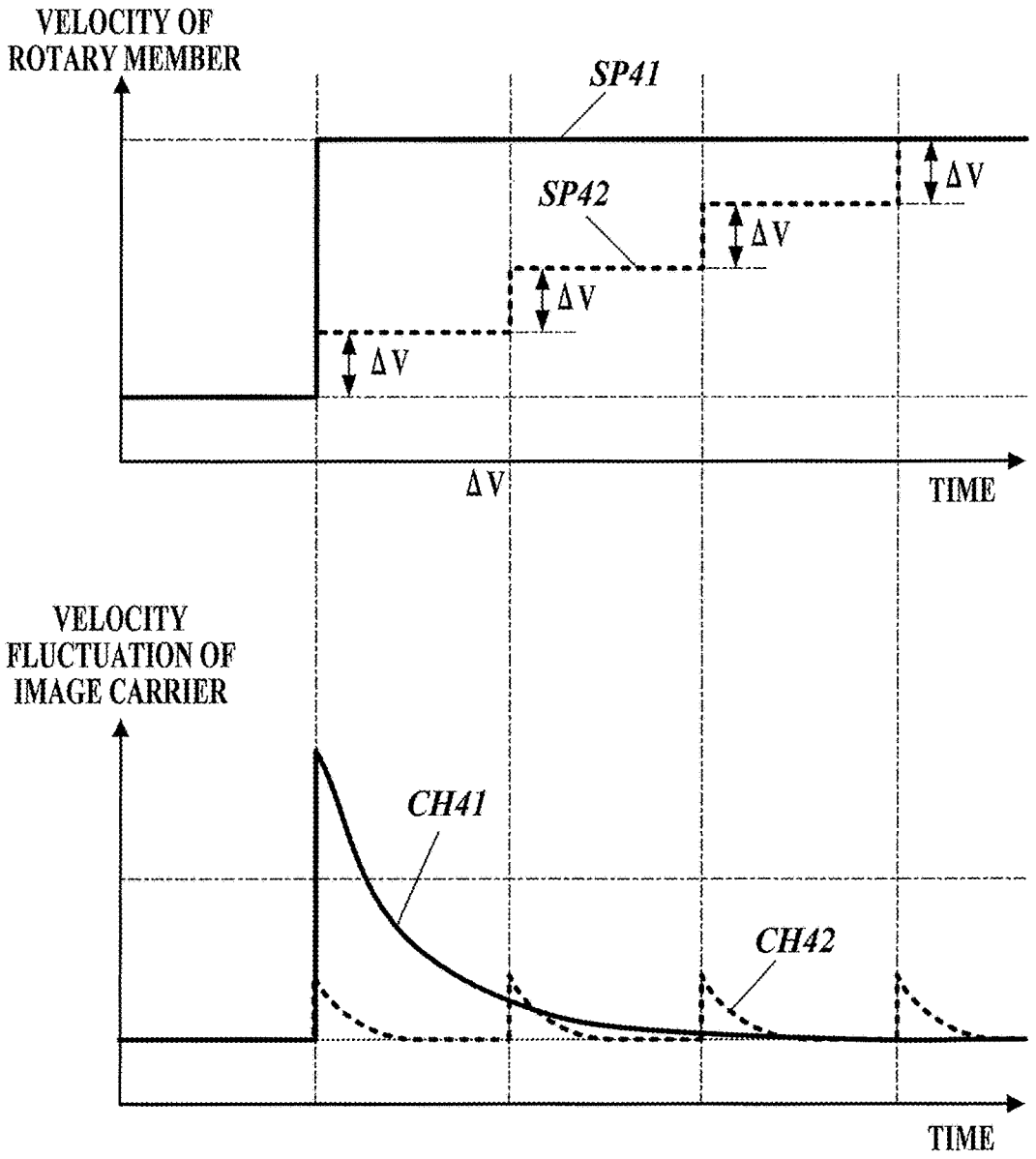
FIG. 4 is an explanatory view of an example of a change of the velocity of a rotary member and the velocity fluctuation of an image carrier.

For example, as illustrated in FIG. 4, when the controller 454 drastically changes the surface velocity of the rotary member 45 as illustrated by SP41, the surface velocity of the image carrier 43 fluctuates to a great extent as illustrated by CH41. The controller 435 controlling the rotation of the image carrier 43 cannot promptly reduce such a large velocity fluctuation in the velocity of the image carrier 43.

To avoid this, the controller 454 changes the surface velocity of the rotary member 45 in stages at predetermined velocity intervals $\Delta V$ as illustrated by SP42 in FIG. 4. As a result, the surface velocity of the image carrier 43 fluctuates as illustrated by CH42. Such velocity fluctuation of the image carrier 43 can be reduced in a short time.

Further, the controller 435 controls the rotation of the image carrier 43 in such a manner that the control coefficient is changed in stages according to the changes made by the controller 454 so that it has the characteristic of attenuating the fluctuation component at the specific frequency related to the changing surface velocity of the rotary member 45.

As described above, the controller 454 changes the surface velocity of the rotary member 45 in stages at predetermined velocity intervals while the controller 435 changes the control of the image carrier driver 431 in stages so as to attenuate the fluctuation component at the specific frequency related to the surface velocity according to the change of the surface velocity. Therefore, the fluctuation of the surface velocity of the image carrier 43 can be reduced in a short time.

While the described embodiment is an example of the image forming apparatus, the embodiments of the present invention are not limited to image forming apparatuses but may also be other apparatuses such as printers.

While the described embodiment is an example in which the image carrier 43 is constituted by the photoreceptor drums, the image carrier 43 may be constituted by an intermediate transfer belt.

While the described embodiment is an example in which the rotary member 45 is constituted by the lubricant applier/remover, the rotary member 45 may be constituted by a cleaning member, a supplementary cleaning member, or a combination of a cleaning member and a supplementary cleaning member. Alternatively, the rotary member 45 may be constituted by a secondary transfer member such as a transfer roller and a transfer belt.

The described embodiment is an example in which a color image on the sheet M is formed by the image forming apparatus 100 that includes image forming units for individual colors such as Y (yellow), M (magenta), C (cyan) and K (black). However, it is only an example, and the embodiments also include image forming apparatuses that form a single color image.

While the described embodiment is an example in which the recording medium is a sheet, the recording medium is not limited to paper but may be any sheet on which a toner image can be formed and fixed such as non-woven, plastic film and leather.

This U.S. patent application claims priority to Japanese patent application No. 2015-184650 filed on Sep. 18, 2015, the entire contents of which are incorporated by reference herein for correction of incorrect translation.

What is claimed is:

1. An image forming apparatus, comprising:

an image carrier;

an image carrier driver which rotates the image carrier;

a rotation detector which detects rotation of the image carrier;

a rotary member in contact with the image carrier, the rotary member being at least one of a lubricant applier, a cleaning member and a supplementary cleaning member;

a rotary member driver which rotates the rotary member;

a first controller which controls the rotary member driver to rotate the rotary member; and a second controller which controls the image carrier driver based on an output of the rotation detector to rotate the image carrier and also controls the image carrier driver in a manner which attenuates a fluctuation component at a specific frequency, wherein when the first controller changes a surface velocity of the rotary member, the second controller controls the image carrier driver in a manner that attenuates a fluctuation component at a specific frequency related to the changed surface velocity of the rotary member.

2. The image forming apparatus according to claim 1, wherein the second controller controls the image carrier driver in a manner which attenuates both a fluctuation component at a specific frequency caused by the image carrier driver and the fluctuation component at the specific frequency related to the surface velocity of the rotary member.

3. The image forming apparatus according to claim 1, wherein the image carrier is constituted by an intermediate transfer belt, and wherein the rotary member is constituted by a secondary transfer member.

4. The image forming apparatus according to claim 3, wherein the secondary transfer member is constituted by a transfer roller or a transfer belt.

5. The image forming apparatus according to claim 1, wherein the rotary member is driven at a surface velocity different from the surface velocity of the image carrier.

6. An image forming apparatus, comprising:

an image carrier;

an image carrier driver which rotates the image carrier;

a rotation detector which detects rotation of the image carrier;

a rotary member in contact with the image carrier;

a rotary member driver which rotates the rotary member;

a first controller which controls the rotary member driver to rotate the rotary member; and a second controller which controls the image carrier driver based on an output of the rotation detector to rotate the image carrier and also controls the image carrier driver in a manner which attenuates a fluctuation component at a specific frequency, wherein when the first controller changes a surface velocity of the rotary member, the second controller controls the image carrier driver in a manner that attenuates a fluctuation component at a specific frequency related to the changed surface velocity of the rotary member, wherein the first controller changes the surface velocity of the rotary member in stages at predetermined velocity intervals, and wherein the second controller changes the control of the image carrier driver in stages so as to attenuate the fluctuation component at the specific frequency related to the surface velocity of the rotary member according to the change of the surface velocity.

7. An image forming apparatus, comprising:

an image carrier;

an image carrier driver which rotates the image carrier;

a rotation detector which detects rotation of the image carrier;

a rotary member in contact with the image carrier;

a rotary member driver which rotates the rotary member;

a first controller which controls the rotary member driver to rotate the rotary member; and a second controller which controls the image carrier driver based on an output of the rotation detector to rotate the image carrier and also controls the image carrier driver in a manner which attenuates a fluctuation component at a specific frequency, wherein when the first controller changes a surface velocity of the rotary member, the second controller controls the image carrier driver in a manner that attenuates a fluctuation component at a specific frequency related to the changed surface velocity of the rotary member, wherein the image carrier is constituted by a photoreceptor drum, and wherein the rotary member is constituted by a cleaning member and/or a supplementary cleaning member.

* * * * *